United States Patent [19]

Möltner

[11] 4,196,838

[45] Apr. 8, 1980

[54] METHODS FOR THE MANUFACTURE OF LONGITUDINAL-SEAM WELDED TUBES

[75] Inventor: Hermann Möltner, Dusseldorf-Oberkassel, Fed. Rep. of Germany

[73] Assignee: Friedrich Kocks GmbH & Company, Dusseldorf, Fed. Rep. of Germany

[21] Appl. No.: 767,902

[22] Filed: Oct. 11, 1977

[30] Foreign Application Priority Data

Feb. 12, 1976 [DE] Fed. Rep. of Germany ..... 2605486

[51] Int. Cl.[2] ..... B23K 31/06

[52] U.S. Cl. ..... 228/151; 228/158; 428/586

[58] Field of Search ..... 428/586; 228/158, 155, 228/151, 125; 72/52, 51, 250

[56] References Cited

U.S. PATENT DOCUMENTS

| | | | |
|---|---|---|---|
| 1,984,083 | 12/1934 | Riemenschneider | 228/158 |
| 1,996,775 | 4/1935 | Sims | 228/151 |
| 3,075,484 | 1/1963 | Benteler | 228/158 |
| 3,590,622 | 7/1971 | Elge et al. | 228/158 |

*Primary Examiner*—Brooks H. Hunt

*Attorney, Agent, or Firm*—Buell, Blenko & Ziesenheim

[57] ABSTRACT

A method for the manufacture of longitudinal-seam welded tubes of substantial thickness is provided in which a strip of steel is curled to form a longitudinally slit tube and the slit is welded in a longitudinal-seam welding plant and in which the seam-welded tube thus produced is fed into a tandem arranged reducing mill, in which it is rolled in the longitudinal direction of the tube between the stands of the reducing mill without being subjected to longitudinal tension while at the same time its external diameter is reduced. A longitudinal seam-welded tube made by the method is claimed.

9 Claims, No Drawings

METHODS FOR THE MANUFACTURE OF LONGITUDINAL-SEAM WELDED TUBES

This invention relates to a method for the manufacture of longitudinal-seam welded tubes, more particularly tubes having a substantial wall-thickness.

Known longitudinal-seam welding equipment, in which a strip of steel is first formed into a slit tube and the slit is then welded, in the present state of the art in Germany can produce only tubes having a maximum wall-thickness of approximately 12 mm. The wall-thickness is very substantially dependent upon the diameter of the tube, so that, in particular, thick-walled tubes of relatively small diameter cannot be manufactured by means of such equipment. Owing to technological developments in many fields however relatively thick-walled tubes are increasingly required as, for example, for the production, conveyance and subsequent processing of mineral oil. Hitherto in such cases it has been necessary to use seamless tubes, whose manufacture is substantially more costly, however, and for whose manufacture substantially more expensive equipment is required than for welded tubes. Owing to the high capital outlay involved in such seamless-tube making equipment, such tubes are manufactured by only a few manufacturers, whose capacity is limited. Moreover, it is not possible to manufacture seamless tubes just of any desired length, and this applies particularly to thick-walled tubes of large outside diameter.

It is known to roll seamless and welded tubes to their final dimensions and at the same time smooth-finishing their outer surfaces. Stretch-reducing mills, arranged in tandem with the manufacturing equipment proper, are often used for this purpose. In the stretch-reducing mills the diameter and wall-thickness of the original tubes are reduced by the application of a relatively substantial tensile force between the roller stands of the mill by suitable adjustment of the roller speeds. In the case of these known methods, the starting material is always a tube or rough-pierced tube blank, whose wall-thickness and outside diameter are greater than those of the finished tube; the outside diameter is then reduced and, in most cases also the wall-thickness, which is maintained approximately constant only in exceptional cases. Consequently, in the case of finished tubes manufactured by conventional methods, the above-mentioned limits pertain.

It is the object of the invention to provide a method of manufacturing longitudinal-seam welded tubes of substantial wall-thickness, e.g. by means of a continuously operating process.

In accordance with the present invention, a steel strip is formed by means of longitudinal-seam welding equipment into a longitudinally slit tube, and its slit is then welded, and the welded tube thus produced is fed into a tandem arranged reducing mill, in which it is rolled in the longitudinal direction of the tube at least without longitudinal tension between the stands while at the same time its outer diameter is reduced by rolling.

The seam welded tube is preferably rolled under longitudinal compression. This enables a longitudinal-seam welded tube, which can be manufactured at relatively low cost, to be produced with a wall-thickness which hitherto has been possible only in the case of seamless tubes. By means of the tube welding equipment an initial tube is produced whose wall-thickness is only such that deformation and welding can be performed without difficulty in the tube welding equipment, to provide a high-quality article. In the reducing mill following the reducing equipment this tube is then first of all given its heavy wall-thickness, which is greater than the wall-thickness it has hitherto been possible to produce in welded tubes. The reducing mill can be of a basically known type, in which, however the rotational speeds of the rollers in the individual stands are chosen differently from those in known rolling mills, namely, so that between the individual stands at least no longitudinal tensile force is exerted. Owing to the reduction of the outside diameter which takes place simultaneously in the roller sizing passes, substantial thickening of the wall is achieved, so that the outside diameter of the finished tube is in fact smaller, but its wall-thickness is substantially greater than that of the original welded tube. If it is desired to achieve an even greater wall-thickness, rolling may be performed in the rolling mill, not just without tension, but with the use of compression in the longitudinal direction of the tube between the individual stands, so that an increase in the wall-thickness is achieved which is substantially more than half the reduction in the diameter and may amount, for example, to 40% or more.

Whereas an arrangement of a reducing mill following longitudinal-seam tube welding equipment in tandem is already known in principle, such cases have always related to reducing mills in which tension is applied between the stands, and which, consequently, at best ensure that the wall-thickness of the initial tube is maintained, but which do not achieve an increase in wall-thickness and certainly do not achieve such a substantial increase in wall-thickness as in the case of the method proposed for the present invention.

The longitudinal compression in the tube, which substantially enhances the increase in wall-thickness, is built up by means of the frictional force of the rollers and by corresponding adjustment of the rotational speeds of the rollers. The greater the compression, the more substantial the increase in the wall-thickness for the same reduction in diameter. Having regard to the limited stiffners of the tube between the rolling mill stands, limits are set to the increase in compression, however. It is accordingly advisable to arrange the rolling mill stands the minimum possible distance apart, as in the case of known stretch-reducing mills.

In many cases it is advantageous if, at least in the stands of the reducing mill which are positioned last in the direction of rolling, the tube is rolled on a mandrel or piercing rod. It is, of course, in principle possible to perform this operation in any other of the stands of the reducing mill. It has the advantage that the finished tubes acquire an accurate internal cross-section. If the method proposed by the present invention is used entirely without an internal tool, which is possible, a precision internal cross-section is obtained if the finished diameter is substantial relative to the wall-thickness. When the wall is relatively thick, the internal cross-section may assume a polygonal shape, which is familiar also in stretch-reducing. Other irregularities of the internal cross-section may also occur. As in an already proposed stretch-reducing method, so also in the case of the method in accordance with the invention, this polygonal formation may advantageously be avoided by means of a special form of sizing pass in which the opening of the sizing pass is reduced in the region of the gaps between the individual rollers defining the sizing pass. However, should the ratio of the wall-thickness to the diameter of the tube exceed a certain value, it is not possible to avoid a polygonal formation without using an internal tool. In such cases it is desirable to use a mandrel or mandrel rod.

When a mandrel rod is used, after welding the tube may be sectioned into lengths, a mandrel rod is then inserted, and the tube, with the mandrel rod inside it, can than be passed through the reducing mill, in which it is rolled. Another possibility, is to section the tube into lengths after welding and to then insert a mandrel rod and feed the tube into the reducing mill, by means of which it is roughed down. If a mandrel rod of suitable cross-sectional size is used, no significant reduction in wall-thickness takes place.

In the case of the last-mentioned method it is possible to roll the tube off the mandrel rod while the rod is axially stationary. A further possibility is to roll the tube off the mandrel rod while the mandrel rod is moving slowly axially through the rolling mill at a slower velocity than the velocity of advancement of the tube through the rollers.

When a mandrel rod or a mandrel is used, its size is so selected that, when it is inserted in the tube, no significant reduction of the wall-thickness takes place, but, in any event, a smooth-finishing process is performed.

While I have described certain preferred, practices and embodiments of my invention in the foregoing specification it will be understood that this invention may be otherwise embodied within the scope of the following claims.

I claim:

1. A method for the manufacture of longitudinal-seam welded tubes of substantial wall-thickness, comprising the steps of curling a strip of steel to form a longitudinally slit tube, welding the slit in a longitudinal-seam welding plant and feeding the seam-welded tube thus produced into a tandem arranged reducing mill, in which it is rolled in the longitudinal direction of the tube between the stands of the reducing mill without being subjected to longitudinal tension while at the same time reducing its external diameter.

2. A method as claimed in claim 1, in which the tube is rolled on a mandrel or a mandrel rod, at least in the stands of the rolling mill which are positioned last in the direction of rolling.

3. A method as claimed in claim 2, in which the tube is sectioned into lengths after being seam welded, a mandrel rod is then inserted, and the tube is then passed, with the mandrel rod inside it, through the reducing mill, in which it is rolled.

4. A method as claimed in claim 2, in which the tube is sectioned into lengths after welding, a mandrel rod is inserted, and the tube with the mandrel rod is then fed into the reducing mill, in which the tube is reduced by rolling.

5. A method as claimed in claim 4, in which the tube is rolled off the mandrel rod while the mandrel rod is axially stationary.

6. A method as claimed in claim 4, in which the tube is rolled off the mandrel rod while the mandrel rod is moving axially through the rolling mill at a slower velocity than the velocity of advancement of the tube between the rollers.

7. A method as claimed in claim 1, in which the seam-welded tube is subjected to axial compression between the stands of the reducing mill.

8. A method as claimed in claim 2, in which the seam-welded tube is subjected to axial compression between the stands of the reducing mill.

9. A method as claimed in claim 3, in which the seam-welded tube is subjected to axial compression between the stands of the reducing mill.

* * * * *